US011541268B2

(12) United States Patent
Auerbach

(10) Patent No.: US 11,541,268 B2
(45) Date of Patent: Jan. 3, 2023

(54) JERK BLOCK, JERK BLOCK SET UP, AND METHOD OF USING THE JERK BLOCK SET UP

(71) Applicant: Joshua Auerbach, Round Rock, TX (US)

(72) Inventor: Joshua Auerbach, Round Rock, TX (US)

( * ) Notice: Subject to any disclaimer, the term of this patent is extended or adjusted under 35 U.S.C. 154(b) by 0 days.

(21) Appl. No.: 16/769,312

(22) PCT Filed: Dec. 3, 2018

(86) PCT No.: PCT/US2018/063538
§ 371 (c)(1),
(2) Date: Jun. 3, 2020

(87) PCT Pub. No.: WO2019/112919
PCT Pub. Date: Jun. 13, 2019

(65) Prior Publication Data

US 2021/0178213 A1 Jun. 17, 2021

Related U.S. Application Data

(60) Provisional application No. 62/594,063, filed on Dec. 4, 2017.

(51) Int. Cl.
*A63B 21/078* (2006.01)
*A63B 21/072* (2006.01)

(52) U.S. Cl.
CPC ..... *A63B 21/078* (2013.01); *A63B 21/0724* (2013.01)

(58) Field of Classification Search
CPC ... A63B 21/078; A63B 21/0724; A63B 21/06; A63B 21/072–0783; A63B 21/00047;
(Continued)

(56) References Cited

U.S. PATENT DOCUMENTS 4,205,838 A * 6/1980 McIntosh ..... A63B 21/078 482/104
6,149,556 A * 11/2000 Jordan ..... A63B 21/078 482/104

(Continued)

OTHER PUBLICATIONS

Rogue Fitness, "Rogue Echo Pulling Block Set," WayBack Machine Web Archive Date Jun. 29, 2017, 10 pages, retrieved from the Internet: https://www.roguefitness.com/rogue-echo-pulling-block-set (Year: 2017).*

(Continued)

*Primary Examiner* — Garrett K Atkinson
*Assistant Examiner* — Kathleen M Fisk
(74) *Attorney, Agent, or Firm* — Jeffrey S. Melcher; Melcher Patent Law PLLC

(57) ABSTRACT

Provided is a jerk block having a platform sized and constructed to hold a plurality of weight plates, a rig connector for removably mounting the platform to a rig support having plurality of holes, and a lock constructed to removably lock or clamp the jerk block in place using at least one of the holes on the rig support. Also provided is a jerk block assembly having two jerk blocks mounted on two rig supports, and a method of using the jerk block assembly to workout lifting weights in which the barbell is only supported on the rig by the weight plates contacting the platforms.

11 Claims, 12 Drawing Sheets

(58) Field of Classification Search
CPC . A63B 2244/09; A63B 21/40; A63B 21/4027; A63B 21/4029; A63B 21/4033
See application file for complete search history.

(56) References Cited

U.S. PATENT DOCUMENTS

| | | | | |
|---|---|---|---|---|
| 7,753,830 | B1 | 7/2010 | Marsh | |
| 9,492,701 | B1 | 11/2016 | Bognatz | |
| 9,555,309 | B1 | 1/2017 | LaBar | |
| 9,682,275 | B2 * | 6/2017 | Kimura | A63B 21/078 |
| 2005/0009671 | A1 * | 1/2005 | Hummer | A63B 71/0036 482/94 |
| 2007/0049472 | A1 * | 3/2007 | Hummer | A63B 71/0036 482/104 |
| 2009/0072111 | A1 | 3/2009 | Piane | |
| 2015/0157892 | A1 | 6/2015 | Johnson | |
| 2016/0023035 | A1 | 1/2016 | Meyer | |
| 2016/0317870 | A1 | 11/2016 | Shane | |
| 2017/0120131 | A1 | 5/2017 | Hedberg | |
| 2017/0246496 | A1 | 8/2017 | Brunswick | |
| 2017/0252600 | A1 | 9/2017 | Kimura | |
| 2018/0064984 | A1 * | 3/2018 | Adrillon | A63B 21/4045 |
| 2018/0178051 | A1 * | 6/2018 | Shaw, Jr. | A63B 21/4029 |

OTHER PUBLICATIONS

Amazon.com, "Cap Coated Dumbbell Weight, Single, Various Sizes", Date First Available Aug. 28, 2009, 3 pages, retrieved from the Internet: https://www.amazon.com/Cap-Coated-Hex-Dumbbell-Weights/dp/B07TB5DD3J (Year: 2009).*

Written Opinion issued in parent PCT/US18/63538, dated Jul. 5, 2019, pp. 1-21.

"SAML-24 Monster Lite Safety Spotter Arms (Pair)" webpage Rogue Fitness, www.roguefitness.com/sami-24-monster-lite-spotter-arms-pair, Jul. 4, 2017 , pp. 1-12.

International Search Report issued in parent PCT/US18/63538, dated Jul. 5, 2019, pp. 1-3.

Rogue Echo Pulling Block Set. Rogue Fitness. Jun. 29, 2017, [retrieved Jan. 29, 2019]. Retrieved from the Internet <URL: https://www .roguefitness.com/rogue-echo-pulling-block-set>.

Applicant's Response to Written Opinion filed in parent PCT/US18/63538, dated Sep. 24, 2019, pp. 1-7.

* cited by examiner

JERK BLOCK, JERK BLOCK SET UP, AND METHOD OF USING THE JERK BLOCK SET UP

FIELD OF THE INVENTION

The invention relates to a jerk block, a jerk block set up and a method of using the jerk block set up to lift weights in which the barbell is only supported by the weight plates on the jerk blocks and the barbell is not supported by the bar.

BACKGROUND OF THE INVENTION

Traditional jerk blocks or Olympic weightlifting technique boxes are traditionally used as a stackable raised platform to move the barbell at different heights off the floor so a person can practice Olympic movements such as clean, snatch, jerk from different positions of the lift without starting from the floor every time. In addition, they are used to help a person practice jerks and allow them to drop the bar so the bar would not end up on the floor or in the front rack position. Not dropping the bar to the floor or to a person's chest would allow the person to attempt multiple jerks without cleaning the weight or receiving the jerk in the catch/front rack position after each jerk. When a lifter gets to the higher percentages of their personal best in that lift, receiving the bar could injure the athlete. This is why jerk blocks are so popular among Olympic weight lifters, collegiate athletes and CrossFit athletes.

Jerk blocks are extremely cumbersome, heavy and take up a lot of space because they must be able to receive several hundred pounds of force as well as move up and down in height. A typical jerk block set up takes up sixteen to twenty square feet of floor space. Due to floor space constraints, cost and storage most gyms are only able to procure one set up.

Conventional jerk block devices are shown in Published U.S. Patent Application Serial Nos. 2017/025260, published on 7 Sep. 2017; 2017/0120131, published on 3 May 2017; and 2015/0157892, published on 11 Jun. 2015, and in U.S. Pat. No. 9,555,309, issued on 31 Jan. 2017; and U.S. Pat. No. 9,682,275, issued on 20 Jun. 2017.

Conventional rig systems utilize a plurality of spaced apart rig supports. The rig supports each contain a plurality of spaced apart holes. Attachments, such as hooks can be connected to the holes at different heights. Typically, the hooks are used to directly contact and hold a weight bar having plates on opposite ends of the weight bar. The rig supports are typically spaced apart less than the total length of the weight bar so that hooks can hold the grip section. A typical weight bar is 2.2 meters in total length, and the length of the grip section is 1.31 meters. Thus, the typical distance between the rig supports is 1.31 meters or less.

SUMMARY OF THE INVENTION

An objective of the invention is to provide a smaller, efficient jerk block system and method using jerk blocks. The jerk block support the barbell by only the weight plates, and the bar is not directly supported by the rig.

The objectives of the invention and other objectives can be obtained by a jerk block comprising:

a platform sized and constructed to hold a plurality of weight plates;

a rig connector for removably mounting the platform to a rig support, the rig support comprising plurality of holes; and a lock constructed to removably lock or clamp the jerk block in place using at least one of the holes on the rig support.

The objectives of the invention and other objectives can be obtained by a jerk block setup comprising:

a first jerk block removably mounted on a first rig support; and a second jerk block removably mounted on a second rig support, wherein the first and second platforms are substantially the same height from a floor and the first and second platforms are spaced apart to support weight plates mounted on a weight bar.

The objectives of the invention and other objectives can be obtained by a method of using the jerk block comprising lifting the weight bar having the weight plates off of a floor and setting the weight plates on the first and second platforms so that the weight bar is supported by the weight plates contacting the first and second platforms.

DETAILED DESCRIPTION OF THE INVENTION

Figure 1:
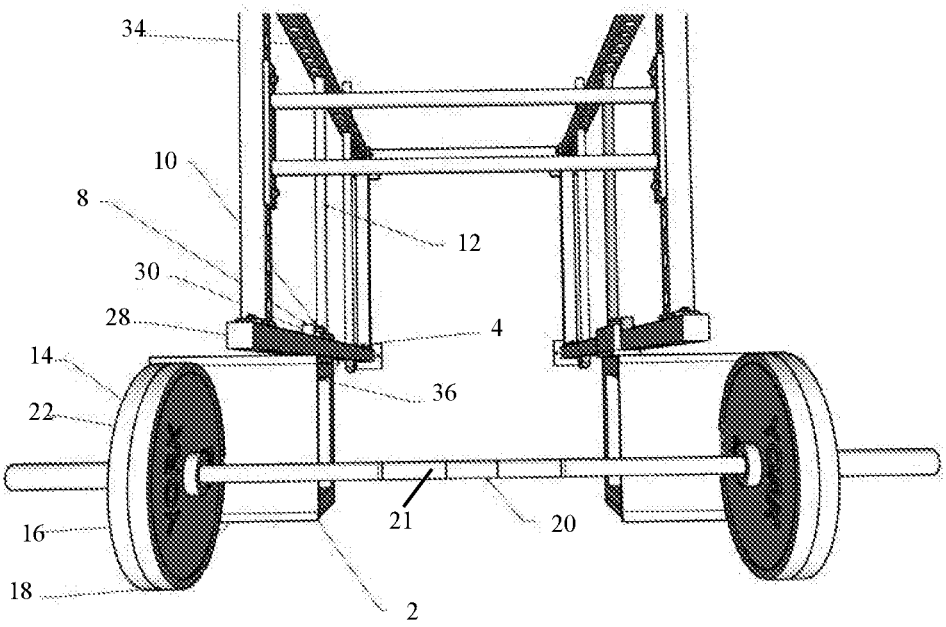
FIG. 1 illustrates a top view of a jerk block setup.
Figure 2:
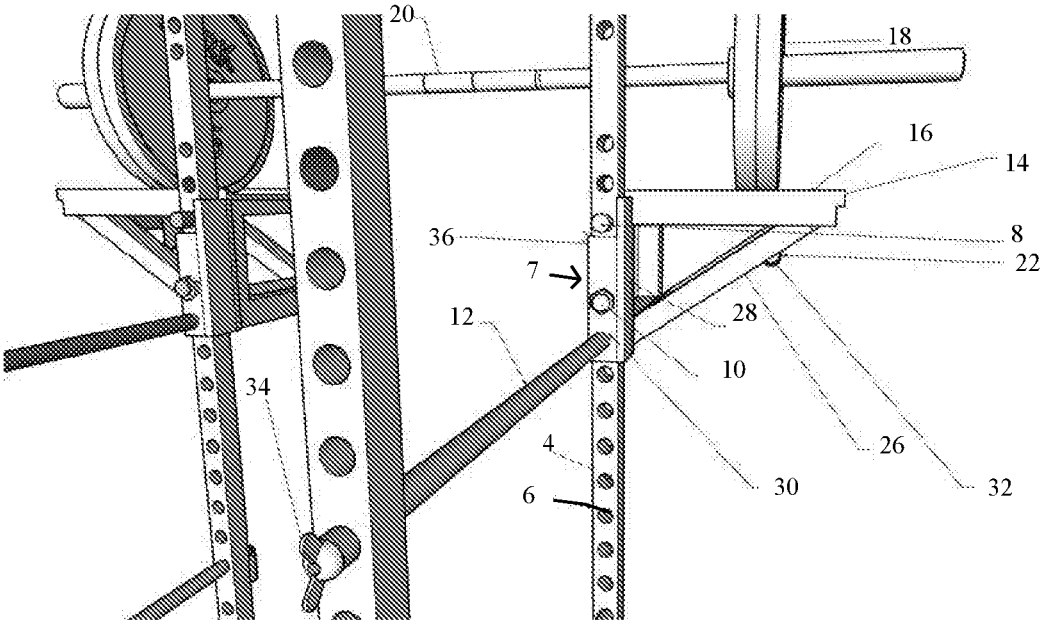
FIG. 2 illustrates a back view of a jerk block setup.
Figure 3:
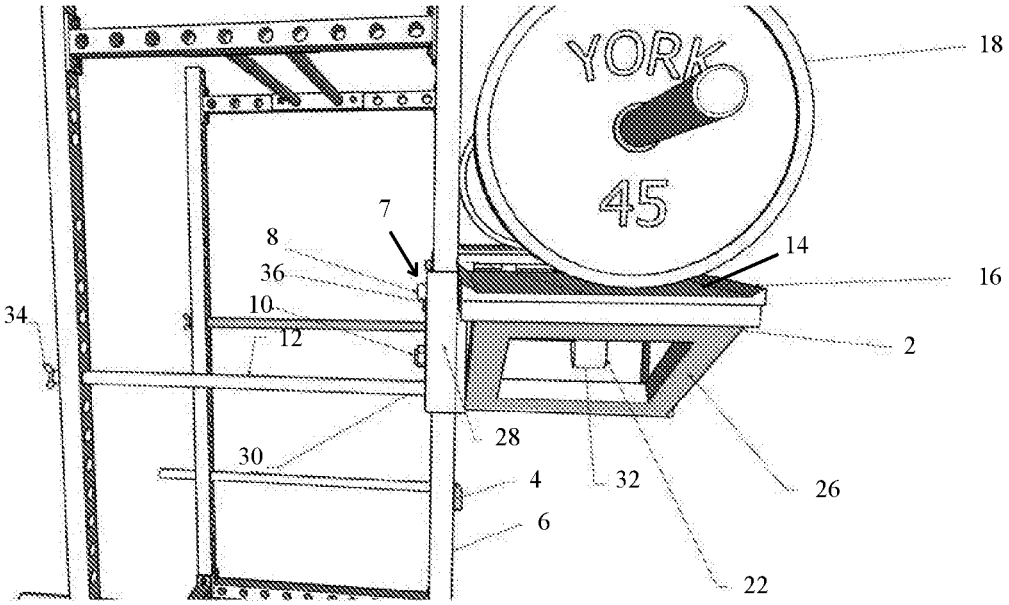
FIG. 3 illustrates a side view of a jerk block setup.
Figure 4:
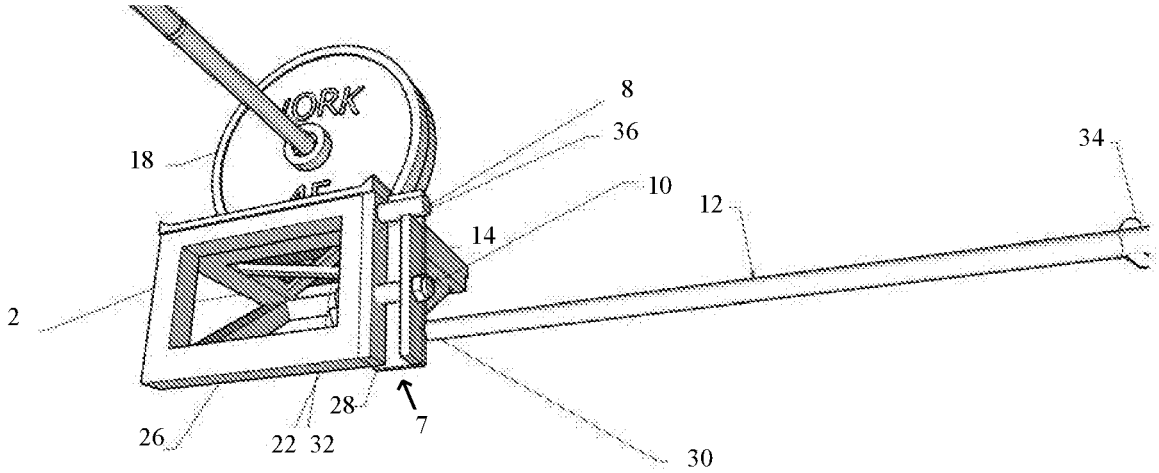
FIG. 4 illustrates a perspective view of a jerk block setup.
Figure 5:
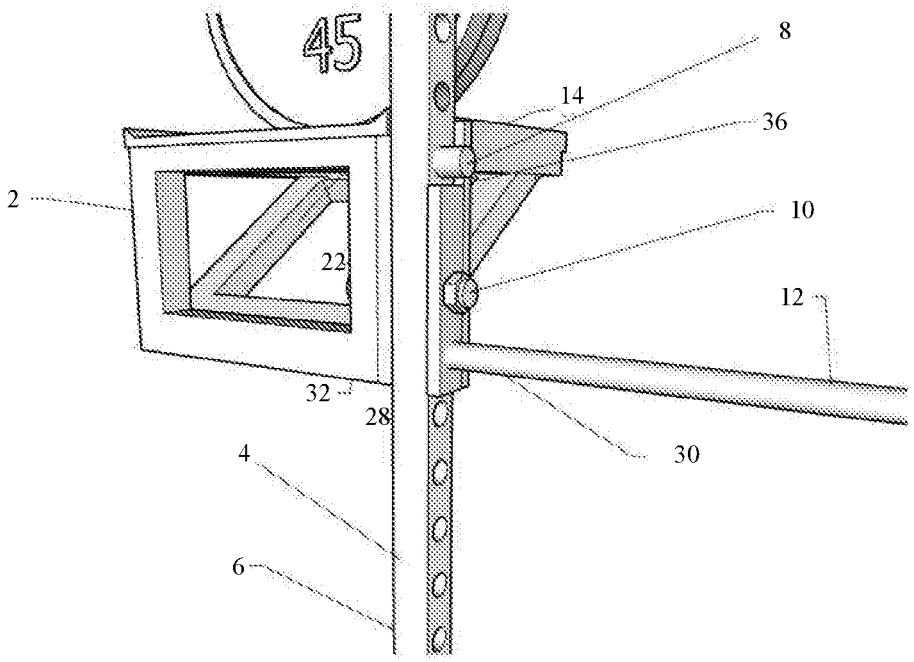
FIG. 5 illustrates a perspective view of a jerk block setup.
Figure 6:
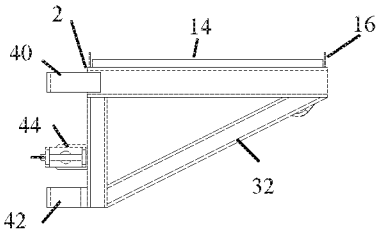
FIG. 6 illustrates a side view of a jerk block.
Figure 7:
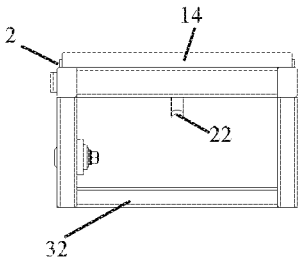
FIG. 7 illustrates a back view of a jerk block.
Figure 8:
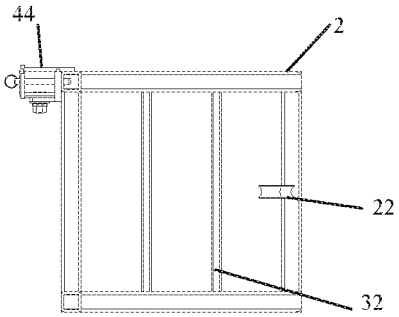
FIG. 8 illustrates a bottom view of a jerk block.
Figure 9:
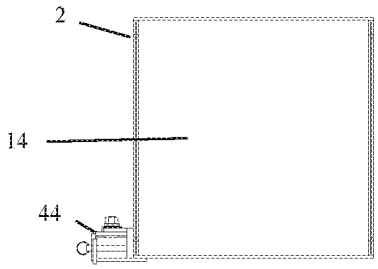
FIG. 9 illustrates a top view of a jerk block.
Figure 10:
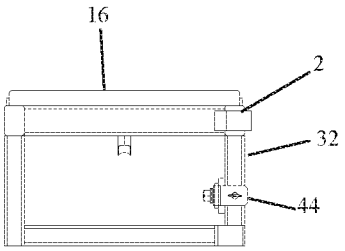
FIG. 10 illustrates a back view of a jerk block.
Figure 11:
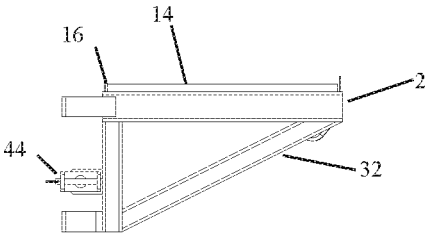
FIG. 11 illustrates a side view of a jerk block.
Figure 12:
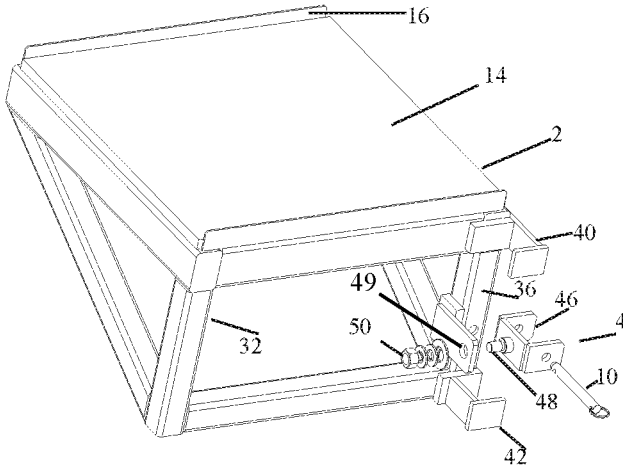
FIG. 12 illustrates a perspective view of a jerk block.
Figure 13:
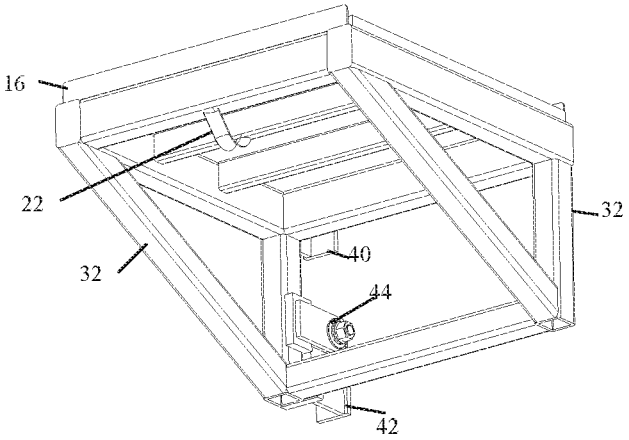
FIG. 13 illustrates a perspective view of a jerk block.
Figure 14:
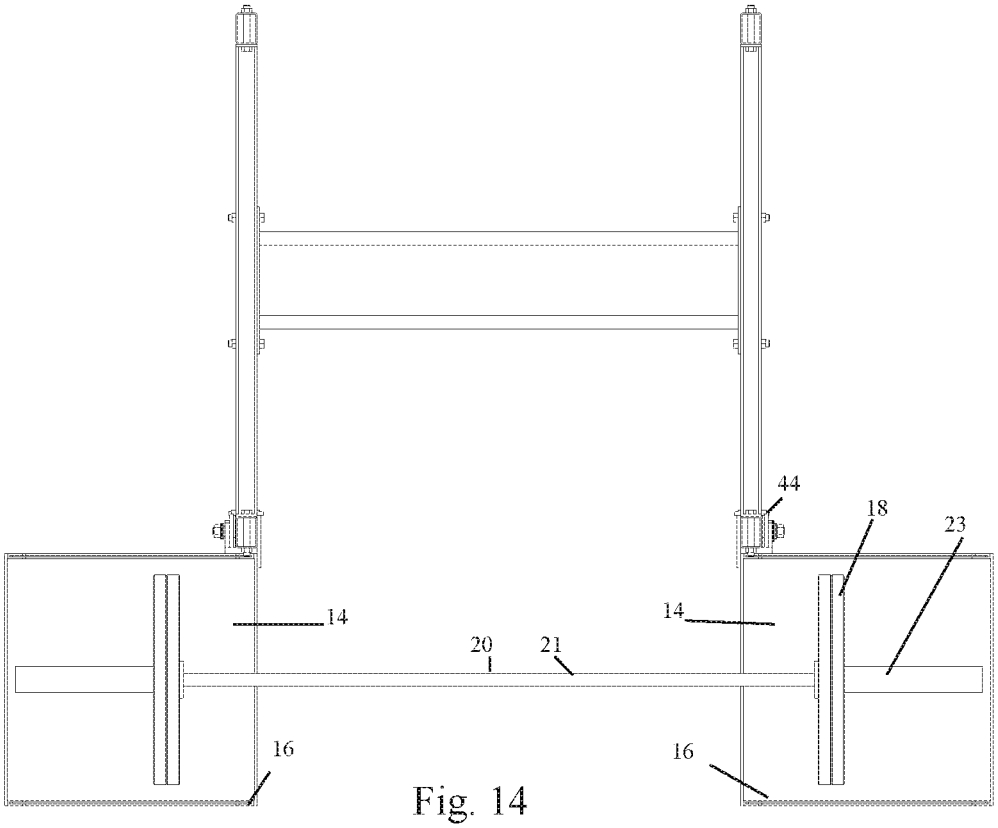
FIG. 14 illustrates a top view of a jerk block setup on a rig.
Figure 15:
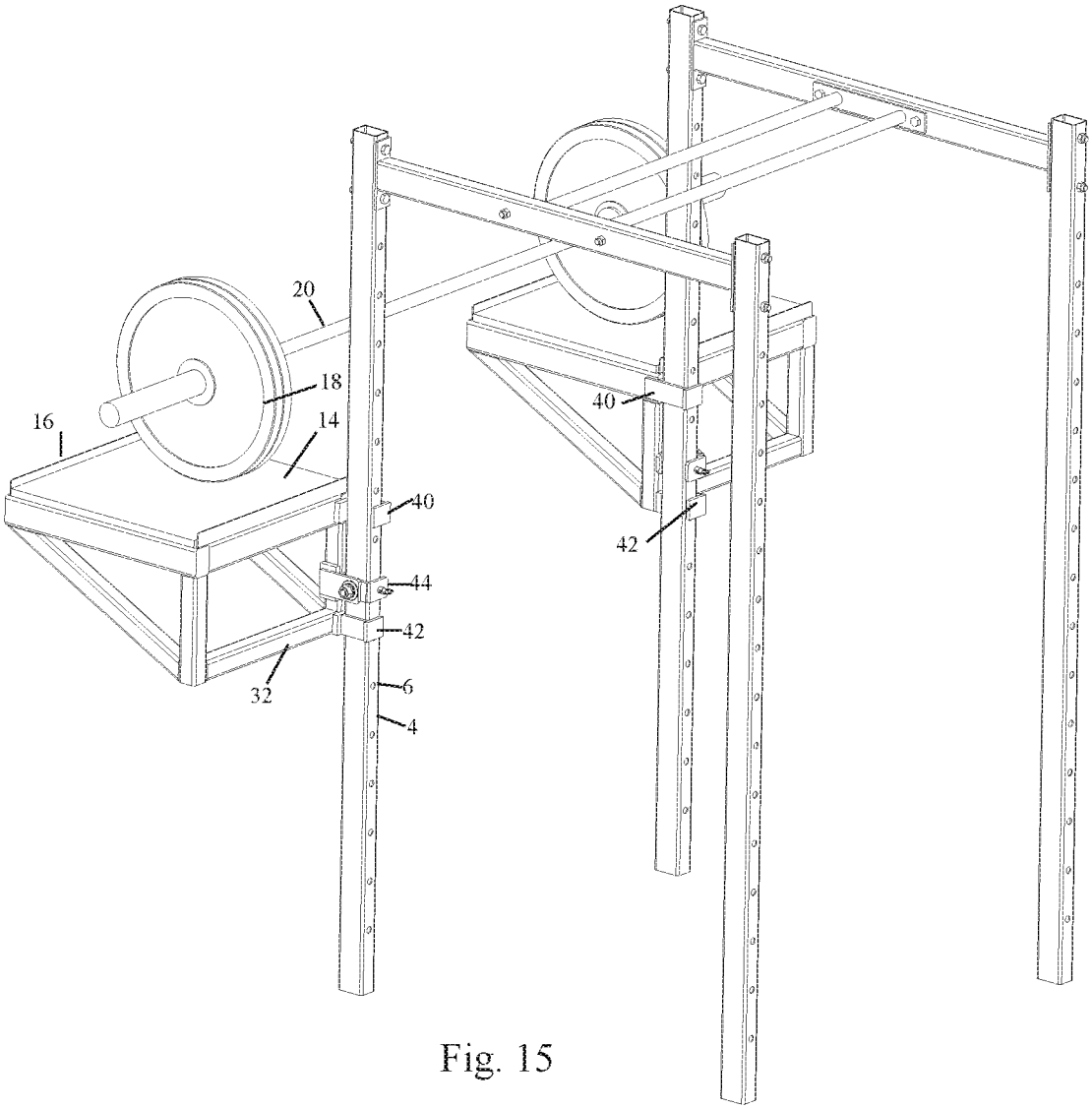
FIG. 15 illustrates a perspective view of a jerk block setup on a rig.
Figure 16:
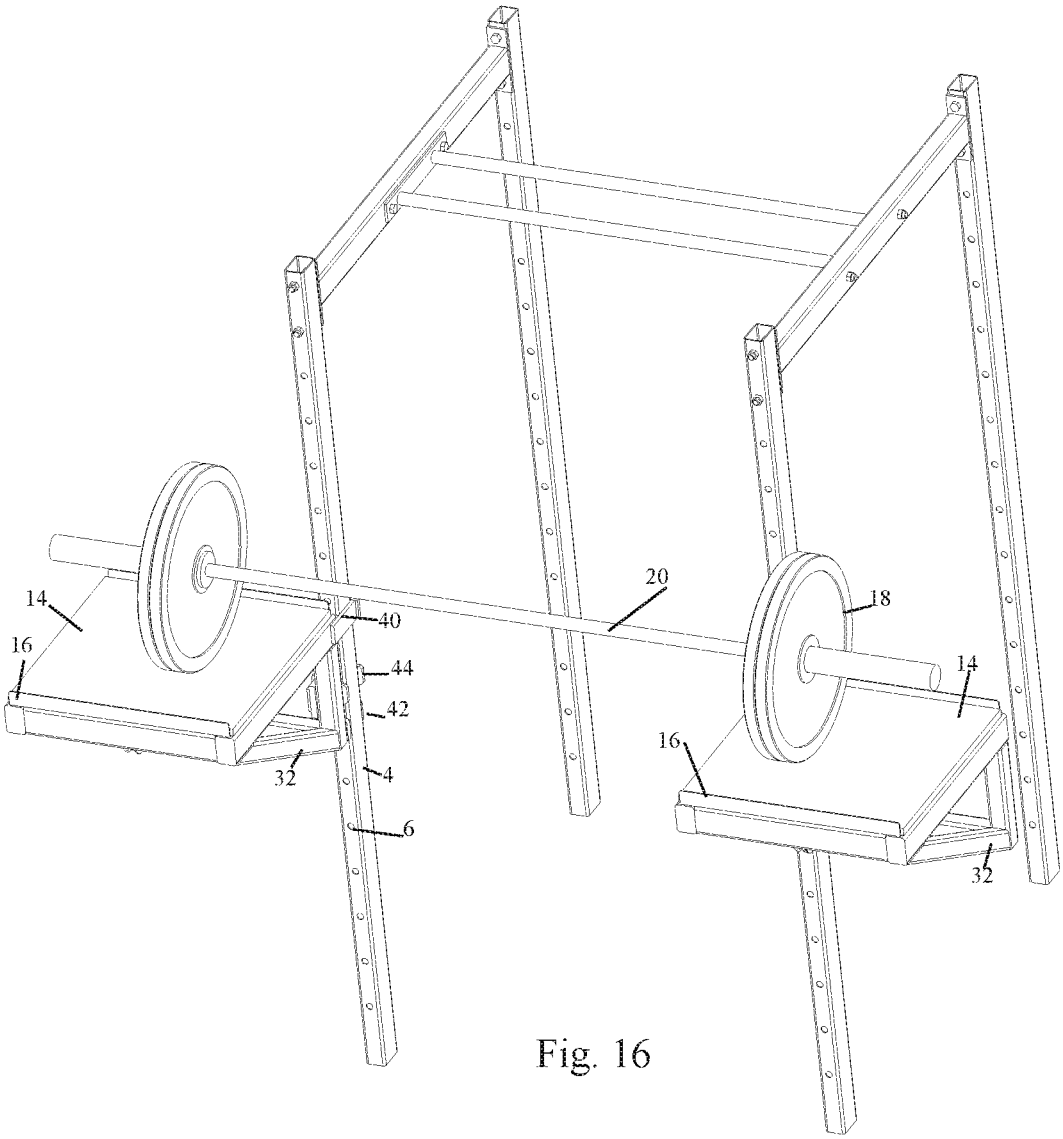
FIG. 16 illustrates a top view of a jerk block setup on a rig.
Figure 17:
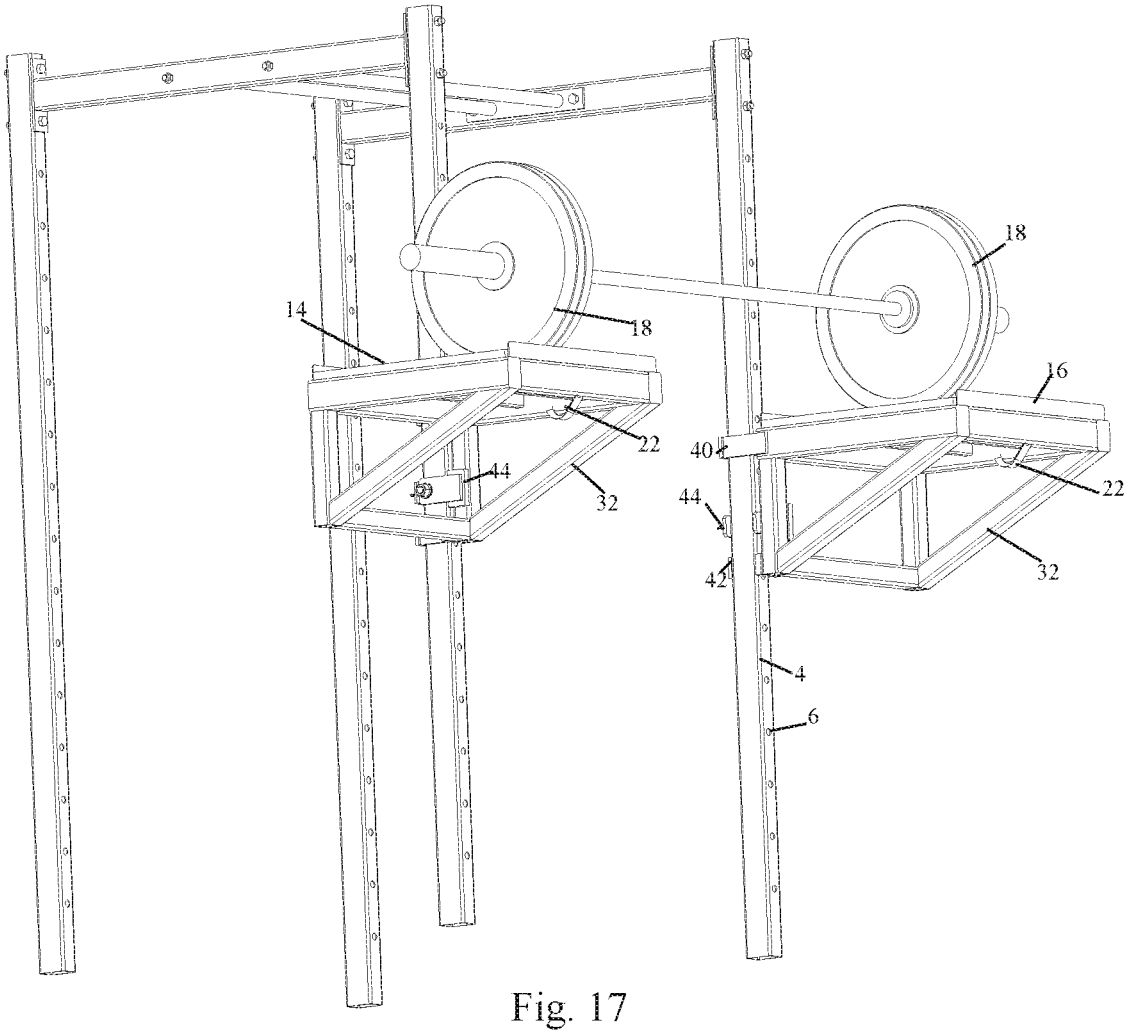
FIG. 17 illustrates a top view of a jerk block setup on a rig.

The invention will now be explained with reference to the attached non-limiting Figures. FIGS. 1-5 illustrate a first embodiment of a jerk block setup on a rig support 4 using a rig connector 7. FIGS. 6-17 illustrate a second embodiment of a jerk block setup on a rig support 4 using a rotatable rig connector 44. The jerk block setup comprises a complimentary pair of jerk blocks 2, each connected to a conventional rig support 4. Conventional rigs comprise spaced apart rig supports 4 having spaced apart holes 6.

A first embodiment shown in FIGS. 1-5 will first be described. The jerk block 2 comprises a platform 14 sized for holding weight plates 18, a frame 32 and a rig connector 7 for connecting the jerk block 2 to a rig support 4. The platform 14 can have indentations or weight chocks 16 for preventing the weight plates 18 from rolling off of the platform. The frame 32 supports the platform 14. The frame has a rig support surface 36 configured for contact with a rig support 4.

The jerk block 2 can be attached to a rig support 4 by any desired rig connector 7. In the first embodiment, the rig connector 7 comprises an attachment pin 8 and a clamp 28.

The jerk block 2 can be first connected by placing attachment pin 8 through one of the holes 6 on the rig support 4. The clamp 28 is configured to contact a second side of the rig support 4 opposite the side of the rig support 4 the rig surface 36 contacts. When the lock pin 10 is inserted into a hole 6 and tightened, the rig support 4 is clamped between the rig surface 36 and the clamp 28 to hold the jerk block 2 in place on the rig support 4

If desired, the optional removable support strut 12 can be installed by feeding the strut 12 through holes 6 in the rear and front rig supports 4. The removable support strut 12 can an elongated piece of steel that seeds through a rear rack support 4 and seeds into a hole on a front support 4 or connects to the clamp 28 in order to give additional support to the jerk block 2 for heavier loads. In this manner, the jerk block 2 is connected to two rig supports 4. The threaded insert 30 allows for the threaded end of the removable strut bar 12 to be connected to the clamp 28 and lock the strut bar 12 in to place and add rigidity to the jerk block 2.

Two jerk blocks 2 can be attached to two spaced apart rig supports 4 to provide a jerk block setup. The jerk blocks 2 can be set to any desired height and should be place at the same height. The jerk blocks 2 are constructed such that the weight plates on a weight lifting bar can contact a surface 14 of the jerk block 2. The jerk blocks 2 are in two forms, complimentary left and right jerk blocks 2, in which the rig connectors 7 are mounted on opposite sides of the platform 14, as shown in the FIGS.

The jerk block 2 can have a band support hook 22 that allows a lifter to attach bands to the ends of the bar 20, such as the weight portion 23, to increase resistance.

A second embodiment is shown in FIGS. 6-17. The free-floating jerk block 2 can be attached to a rig support 4. Two free-floating jerk block 2, a left jerk block 2A and a right jerk block 2B can be mounted on associated rig supports 4, as shown in FIGS. 9-12, to form a jerk block setup.

In the second embodiment, shown in FIGS. 6-17, a rotatable rig connector 44 can be used to connect the jerk block 2 to the rig support 4. The rig connector 44 comprises a yoke 46 having holes in which the lock pin 10 is inserted through and the hole 6 to lock the yoke 46 to the rig support 4. The yoke contacts at least two surfaces of the rig support 4. The yoke has a pivot 48 substantially perpendicular to the direction of the lock pin 10 in the rig hole 6. The pivot 48 connects to pivot mount 49 on the frame 32 and then locked using a fastener 50. The pivot 48 allows rotation of the jerk block 2 in relation to the rig support 4 to prevent torque on the pin 10 through the hole 6 and to avoid elongation or deformation of the hole 6 in the rig support 4. The jerk block 2 can rotate about the pivot 48 in a vertical plane. The rotatable rig connector 44 prevents the jerk block 2 from sliding down the rig support 4. The rig connector 44 further comprises at least one rig support bracket to prevent rotation of the platform 14 in relation to the rig 4. Preferably, the rig connector 44 comprises an upper rig support bracket 40 and a lower rig support bracket 42. The upper rig support bracket 40 is configured to contact a first side surface and a back side surface of the rig support 4. The lower rig support bracket 42 is configured to contact a second side surface and the back side surface of the rig support 4. The first side surface opposing the second side surface. The upper and lower rig support brackets 40 and 42 prevent the jerk block 2 from rotating in relation to the rig support 4, and transfer rotational forces from the platform 14 to the rig support 4.

Definitions

Rig supports 4 or legs of the rack are the free-floating jerk block attaches to. Rig/Rack Support Holes 6: The holes in the support legs or in the rig that allow a person to attach various components.

Attachment pin 8: The pin on the free floating jerk block 2 allows a person to seed the pin or cylinder steel 8 through the holes 6 in the rig support 4 in order to place the jerk block 2 on the rig 4 at the various desired heights suspending the jerk block 2 and allowing the user the ability to attach the jerk block 2 to the rig support 4 without clamping the jerk block 2 down or locking it into place.

Lock pin 10: The lock pin 10 can be a through bolt or cylindrical piece of steel designed to seed through another hole 6 allowing the user to lock the jerk block 2 into place and clamp down on the rig support 4 in order to gain additional support and stability.

Removable Support Strut 12: In the first embodiment, the removable support strut bar 12 can an elongated piece of steel that seeds through a rear rack support 4 and seeds into a hole on a front support 4 or connects to the clamp 28 in order to give additional support to the jerk block 2 for heavier loads. In this manner, the jerk block 2 is connected to two rig supports 4.

Platform 14: The platform 14 is the flat area on the top part of the jerk block 2 that rests on top of the frame of the jerk block 2. The platform 14 is designed to support the weight plates 18 and load and displace the force of the load from the weight plates 18 contacting the platform 14 to the frame 32.

Weight Chock 16: The weight chock or indentation 16 is designed to stop the weights 18 from rolling off the platform 14. The weight chock 16 should be at least located on a front of the platform 14 away from the rig support 4, and an additional weight chock 16 can be located at a back of the platform 14 near the rig support 4.

Weights Plates 18: The weight plates 18 are added to the weight portion 23 of the bar 20 to increase the load or resistance for the person using lift.

Grip portion 21 the bar 20: The grip portion 21 is the part of the bar 20 that the person performing the lift holds while performing the lift.

Band Attachment Hook 22: The hook 22 allows the user to attach bands from the jerk block 2 to the bar 20 to add resistance to the bar 20 the person using the free-floating jerk blocks 2.

Frame 32: The frame 32 supports the platform 14. The frame 32 can comprise a back support 26 and an angle support 24. The frame 32 supports the platform 14 and the weight plates 18 and displaces the velocity or force of the weight plates 18 into the platform 14 and rig supports 4.

Rig support surface 36: The frame 32 has a rig support surface 36 configured to contact a first side of a rig support 4 when the jerk block 2 is mounted on a rig support 4.

Clamp 28: The clamp 28 is configured to contact a second side of the rig support 4 opposite the side of the rig support 4 the rig surface 36 contacts. In the first embodiment, when the lock pin 10 is inserted into a hole 6 and tightened, the rig support 4 is clamped between the rig surface 36 and the clamp 28 to hold the jerk block 2 in place on the rig support 4.

Threaded Insert 30 for removable strut 12: The threaded insert 30 allows for the threaded end of the removable strut bar 12 to be connected to the clamp 28 and lock the strut bar 12 in to place and add rigidity to the jerk block 2 when mounted in the first embodiment.

Strut Support fastener 34: The strut support fastener 34 can be any suitable fastener, such as a nut, that allows the user to tighten the fastener 34 on a threaded end of the strut bar 12 and lock the strut bar 12 to another rig support 4 that is different from the rig support 4 the jerk block 2 is connected to.

Rotatable rig connector 44: In the second embodiment a rotatable rig connector 44 can be used to connect the jerk block 2 to the rig support 4. The rig connector 44 comprises a yoke 46 having holes in which the lock pin 10 is inserted through and the hole 6 to lock the yoke 46 to the rig support 4. The yoke contacts at least two surfaces of the rig support 4. The yoke has a pivot 48 substantially perpendicular to the direction of the lock pin 10 in the rig hole 6. The pivot 48 connects to pivot mount 49 on the frame 32 and then locked using a fastener 50. The pivot 48 allows rotation of the jerk block 2 in relation to the rig support 4 to prevent torque on the pin 10 through the hole 6 and to avoid elongation or deformation of the hole 6 in the rig support 4. The jerk block 2 can rotate about the pivot 48 in a vertical plane. The rotatable rig connector 44 prevents the jerk block 2 from sliding down the rig support 4.

Rig upper support bracket 40 and lower support bracket 42: The second embodiment of the jerk block 2 has rig connector comprising an upper rig support bracket 40 and a lower rig support bracket 42. The upper rig support bracket 40 is configured to contact a first side surface and a back side surface of the rig support 4. The lower rig support bracket 42 is configured to contact a second side surface and the back side surface of the rig support 4. The first side surface opposing the second side surface. The upper and lower rig support brackets 20 and 42 prevent the jerk block 2 from rotating in relation to the rig support 4, and transfer rotational forces from the platform 14 to the rig support 4.

In the first embodiment, the jerk block 2 can placed at the desired height for the user by lifting the jerk block 2 and spinning it clock wise to attach the jerk block 2 to the left rig support 4 in order to clear the top of the attachment 28 from hitting or making contact with the rig support 4. The user can then place the attachment pin 8 through the hole 6 and ensure the attachment pin 8 was seeded fully through the hole 6 so that the inside of rig contact surface 36 is flush against the rig support 4. Next the user would tighten the lock pin 10 to force the clamp 28 to be flush against the rig support 4 so that the jerk block 2 would be held in place and supported by the attachment pin 8, lock pin 10 and clamp 28. Next the user would install the complimentary jerk block 2 and make sure to line up the height with the first jerk block 2. There are complimentary jerk blocks 2 as shown in the FIGS. Next depending on the load being put on the jerk blocks 2 the user might choose to install the support strut 12 by seeding the support strut 2 through a rear rig support 4 and a jerk block 2 mounted on a front rig support 4. Next the user would insert a threaded end of the support strut 12 to be spun clockwise into the threaded insert 30 and then tightened by the fastener 34 to lock the support strut 12 in to place and add the extra support to the jerk block 2. Next the user would take a barbell bar 20 of any kind and add weights 18 to the weight part 23 of the bar 20 and place the weights 18 on the platforms 14 so the user could begin training.

In the second embodiment, the user can install the complimentary left and right rotatable connectors 44 to associated rig supports 4 at the same height. The yoke 46 can be installed over the rig support 4 at the desired height and then the lock pin 10 can inserted through holes in the yoke 46 and the hole 6. The jerk blocks 2 can then be installed by connecting the pivot mount 49 to the pivot 48 and then locking the pivot 48 using the fastener 50. The two complimentary jerk blocks 2 can placed at the desired height in this manner.

The jerk blocks 2 can be designed or modified to attach to any rig set up at any gym. The advantage to attaching to the rig is so that the athlete can adjust the blocks to different heights quickly and easily using the preexisting holes on the rig in lieu of adding big and heavy jerk boxes. The single support design saves space and because the athlete can move the blocks up and down the preexisting holes and on the rig, would allow the jerk blocks to be adjusted to around 50 different heights without buying additional boxes this design is not only sturdy but ergonomic and sleek as well. Another advantage is a gym owner could buy multiple set ups and not have the issue of taking up a lot of valuable floor space. These jerk blocks give gym owners a huge advantage when it comes to space. Because of the lack of floor space that a set takes up a gym owner would be able to use multiple set ups and a class or as many athletes as rig space permits. Another advantage of these jerk blocks is there are many other types of exercises an athlete can performed other than the typical exercises performed while using Jerk Blocks. This design would include an attachment for bands on the outside of the block so that athletes could use band resistance when squatting or quickly and easily be moved to a platform for many other exercises such as Anderson Squats.

The invention relates to a jerk block set up because the science behind the purpose of the jerk blocks is the same. Jerk blocks, also referred to as Olympic weightlifting technique boxes, are traditionally used as a stackable raised platform to move the barbell at different heights off the floor so a person can practice Olympic movements such as clean, snatch, jerk from different positions of the lift without starting from the floor every time. In addition, they are used to help a person practice jerks and allow them to drop the bar so the bar would not end up on the floor or in the front rack position. Not dropping the bar to the floor or to a person's chest would allow the person to attempt multiple jerks without cleaning the weight or receiving the jerk in the catch/front rack position after each jerk. When a lifter gets to the higher percentages of their max, receiving the bar could injure the athlete. This is why jerk blocks are so popular among Olympic weight lifters, collegeic athletes and CrossFit athletes.

The invention allows the athlete to also use a weight lifting rig to support the jerk blocks. Allowing an athlete to operate from a variety of heights and move the blocks up and down the holes in the rig. Additionally, the jerk locks have hooks on the blocks that allow the athlete to use bands and band resistance or perform Anderson squats and other dynamic exercises that these rigs supported jerk blocks would allow a person to come up with.

The jerk blocks 2 allow the weight plates 18 to be directly supported by the platform 14 and barbell bar 20 is suspended and held by the platform 14. The bar 20 is not directly supported by the rig supports 4. Additionally, the jerk blocks 2 are solely supported by any rig support 4 they attach to and do not use additional ballast or any additional platform support that is supported by ground/floor. The jerk block 2 is supported by the rig connector 7 or 44 and does not require any additional supports other than the rig support 4 the jerk block 2 attaches to.

The platform 14 size can be as desired, preferably a width from 6 inches (15 cm) to 48 inches (122 cm) and a length of from 6 inches (15 cm) to 48 inches (122 cm), and can have any desired shape, such as rectangle, square, oval, etc. The platform 14 is designed to support the weight plates 18, not the grip portion 21 of the bar 20. Exemplary weights 18 supported by the jerk blocks 2 is from 50 pounds (22 Kg) up to 500 pounds (226 Kg) or more. Additionally, the jerk blocks 2 are solely supported by rig supports 4 and do not use additional ballast or any additional platform support that is supported by ground/floor.

The jerk block 2 design is ergonomic, dynamic, light weight, this design has a single support leg that attaches to the rig support 4. Other designs are mostly based on the original jerk block design and these models that take up a lot of floor space, cumbersome, and often have more than one component for each block. Such as an extra support brace that bolts onto the jerk block. The free-floating jerk blocks will take up around of 5 or 6 square feet in comparison to most models that take up approximately 16-24 square feet. The present free-floating design is built around our single rig support 7, 44 that attaches to the rig support 4. This single support not only makes these jerk blocks 2 strong by displacing force into the rig support 4 but it also allows the user to quickly adjust to variable heights along the rig down to the last 15" without taking up valuable floor space. Once the floating jerk block is at the bottom position which is around 15" off the floor, the user the ability to use the bands that hook on to the edges of the blocks to add resistance. The new design allows users to quickly shift from one height to the next easily and quickly. The hook 22 on outside of the blocks allows the user to add bands as resistance to increase the difficulty of the lift while using lower weights.

I have always been an advocate for using jerk blocks because they allow a person to work from different aspects of an Olympic lift without having to pick the barbell up from the floor each time. Many athletes struggle with cleans, or snatches from the different positions but as an example the position right below the knee is always one of the most difficult transitions. The jerk blocks 2 allow a person to train from that position or other difficult levels of the lift allowing the athlete to work on their deficiency's without performing a lift hundreds or thousands of times incorrectly with that deficiency and developing bad habits. However, most people, gyms, and programs can only afford to have one full set up because they are huge and take up a lot of floor space and functionality. My system gives a coach the ability to own and store multiple sets of jerk blocks, providing the coach the ability to coach multiple athletes at once instead of one person at a time.

It should be understood, of course, that the foregoing relates to exemplary embodiments of the invention and that modifications may be made without departing from the spirit and scope of the invention as set forth in the following claims. Any desired structure to connect the jerk block to the rig support 4 can be utilized.

The invention claimed is:

1. A jerk block setup comprising:

a weight lifting rig comprising a first rig support and a second rig support spaced apart 1.31 meters or less, the first rig support and the second rig support are connected at a top of the weight lifting rig, the first rig support and the second rig support rise vertically from a floor, the first rig support and the second rig support are parallel, the first rig support and the second rig support each have a plurality of holes spaced along their length;

a first jerk block removably mounted on the first rig support, wherein the first jerk block comprising a first platform having a first flat surface sized and constructed to hold a first plurality of weight plates dropped thereon and a first weight chock to prevent the first plurality of weight plates from rolling off of the first flat surface of the first platform, the first platform has a size of 35 cm to 60 cm in length and 35 cm to 60 cm in width and is configured to support the first plurality of weight plates and not a grip portion of a bar of a barbell weight bar, a first rig connector for removably mounting the first platform to the first rig support so that the first flat surface is horizontal, and a first lock constructed to removably lock or clamp the first jerk block in place using at least one of the plurality of holes on the first rig support, wherein the first jerk block is supported above the floor by the first rig support; and a second jerk block removably mounted on the second rig support, wherein the second jerk block comprising a second platform having a second flat surface sized and constructed to hold a second plurality of weight plates and a second weight chock to prevent the second plurality of weight plates from rolling off of the second flat surface of the second platform, the second platform has a size of 35 cm to 60 cm in length and 35 cm to 60 cm in width and is configured to support the second plurality of weight plates and not the grip portion of the bar of the barbell weight bar, a second rig connector for removably mounting the second platform to the second rig support so that the second flat surface is horizontal, and a second lock constructed to removably lock or clamp the second jerk block in place using at least one of the plurality of holes on the second rig support, wherein the second jerk block is supported above the floor by the second rig support, wherein the first flat surface of the first jerk block and the second flat surface of the second jerk block are the same height from a floor, and the first and second flat surfaces are spaced apart to support the first and second plurality of weight plates mounted on the barbell weight bar and not support the bar, and to allow a weight lifter to stand between the first and second flat surfaces to perform clean, snatch or jerk lifts of the first and second plurality of weight plates from or to the first and second flat surfaces.

2. A method of using the jerk block setup of claim 1 comprising lifting the barbell weight bar off of the floor and setting the first plurality of weight plates on the first platform of the first jerk block and the second plurality of weight plates on the second platform of the second jerk block so that the barbell weight bar is solely supported by the first and second plurality of weight plates contacting the first and second platforms.

3. The method according to claim 2, wherein a weight lifter stands between the first and second flat surfaces and performs clean, snatch or jerk lifts of the first and second plurality of weight plates from or to the first and second flat surfaces.

4. The jerk block setup according to claim 1, wherein there is an open space between the first and second rig supports so that a user is capable of standing between the first and second rig supports.

5. The jerk block setup according to claim 1, wherein the first jerk block is solely supported by the first rig support and the second jerk block is solely supported by the second rig support.

6. A jerk block comprising:

a platform having a flat surface sized and constructed to hold a plurality of weight plates and a weight chock to prevent the plurality of weight plates from rolling off of the flat surface of the platform, the platform has a size of 35 cm to 60 cm in length and 35 cm to 60 cm in width and is configured to support the plurality of weight plates mounted on a barbell weight bar dropped thereon and not a grip portion of a bar of the barbell weight bar;

a rig connector for removably mounting the platform to a first rig support of a weight lifting rig so that the flat surface is horizontal, the weight lifting rig comprising the first rig support and a second rig support spaced apart 1.31 meters or less, the first rig support and the second rig support are connected at a top of the weight lifting rig, the first rig support and the second rig support rise vertically from a floor, the first rig support and the second rig support are parallel, the first rig support and the second rig support each have a plurality of holes spaced along their length; and a lock constructed to removably lock or clamp the jerk block in place using at least one of the plurality of holes on the first rig support, wherein the jerk block is configured for use of clean, snatch or jerk lifts of the plurality of weight plates from or to the platform when the jerk block is mounted on the first rig support, and wherein the jerk block is configured to be supported above the floor by the first rig support.

7. The jerk block according to claim 6, further comprising a support strut constructed to removably mount the jerk block to a second rig support of the weight lifting rig, such that when the jerk block is mounted on the first rig support, the second rig support is rearward of the first rig support to provide additional support on the jerk block for supporting heavier loads than when the jerk block is mounted solely on the first rig support.

8. The jerk block according to claim 6, further comprising a frame configured to support the platform, the frame having a rig support surface configured to contact a side surface of the first rig support, wherein the rig connector comprises a clamp and the lock comprises a locking pin configured such that the first rig support is configured to be clamped between the clamp and the rig support surface by fastening the locking pin.

9. The jerk block according to claim 6, further comprising a frame configured to support the platform, the frame having a rig support surface configured to contact a side surface of the first rig support and a pivot mount, wherein the rig connector comprises a yoke configured to connect to the first a rig support, the yoke having a pivot configured to connect to the pivot mount to allow rotation of the platform in relation to the first rig support, and at least one bracket configured to prevent rotation of the platform in relation to the first rig support.

10. A jerk block setup comprising:

a first jerk block removably mounted on a first rig support of a weight lifting rig, wherein the first jerk block comprising a first platform having a first flat surface sized and constructed to hold a first plurality of weight plates and a first weight chock to prevent the first plurality of weight plates from rolling off of the first flat surface of the first platform, the first platform has a size of 35 cm to 60 cm in length and 35 cm to 60 cm in width and is configured to support the first plurality of weight plates and not a grip portion of a bar of a barbell weight bar, a first rig connector for removably mounting the first platform to the first rig support so that the first flat surface is horizontal, the first rig support comprising a plurality of holes, and a first lock constructed to removably lock or clamp the first jerk block in place using at least one of the plurality of holes on the first rig support;

a second jerk block removably mounted on a second rig support of the weight lifting rig, wherein the second jerk block comprising a second platform having a second flat surface sized and constructed to hold a second plurality of weight plates and a second weight chock to prevent the second plurality of weight plates from rolling off of the second flat surface of the second platform, the second platform has a size of 35 cm to 60 cm in length and 35 cm to 60 cm in width and is configured to support the second plurality of weight plates and not the grip portion of the bar of the barbell weight bar, a second rig connector for removably mounting the second platform to the second rig support so that the second flat surface is horizontal, the second rig support comprising a plurality of holes, and a second lock constructed to removably lock or clamp the second jerk block in place using at least one of the plurality of holes on the second rig support, wherein the first flat surface of the first jerk block and the second flat surface of the second jerk block are the same height from a floor, and the first and second flat surfaces are spaced apart to support the first and second plurality of weight plates mounted on the barbell weight bar and not support the bar, and to allow a weight lifter to stand between the first and second flat surfaces to perform clean, snatch or jerk lifts of the first and second plurality of weight plates from or to the first and second flat surfaces; and a first support strut removably mounting the first jerk block to a third rig support of the weight lifting rig rearward of the first rig support to provide additional support on the first jerk block for supporting heavier loads than when the first jerk block is mounted solely on the first rig support.

11. The jerk block setup according to claim 10, further comprising a second support strut removably mounting the second jerk block to a fourth rig support rearward of the second rig support to provide additional support on the second jerk block for supporting heavier loads than when the second jerk block is mounted solely on the second rig support.

* * * * *